United States Patent [19]

Wanou et al.

[11] Patent Number: 5,012,282

[45] Date of Patent: Apr. 30, 1991

[54] BRUSH CONTACT TYPE CHARGING UNIT IN AN IMAGE FORMING APPARATUS

[75] Inventors: Masahiro Wanou, Kawasaki; Masatoshi Kimura, Ebina; Junzo Nakajima, Yokohama, all of Japan

[73] Assignee: Fujitsu Limited, Kawasaki, Japan

[21] Appl. No.: 295,557

[22] Filed: Jan. 11, 1989

[30] Foreign Application Priority Data

Feb. 25, 1988 [JP] Japan ..... 63-43223

[51] Int. Cl.[5] ..... G03G 15/02

[52] U.S. Cl. ..... 355/219; 361/235

[58] Field of Search ..... 355/219, 221, 216; 361/235

[56] References Cited

U.S. PATENT DOCUMENTS

| | | | |
|---|---|---|---|
| 4,387,980 | 6/1985 | Ueno et al. | 355/219 |
| 4,455,078 | 6/1984 | Mukai et al. | 355/219 |
| 4,727,463 | 2/1988 | Suzuki | 355/219 X |
| 4,761,709 | 8/1988 | Ewing et al. | 355/219 X |
| 4,783,716 | 11/1988 | Nagase et al. | 355/219 X |
| 4,803,593 | 2/1989 | Matsumoto et al. | 355/219 X |
| 4,868,729 | 9/1989 | Suzuki | 355/219 X |

FOREIGN PATENT DOCUMENTS

| | | | |
|---|---|---|---|
| 54-124994 | 9/1979 | Japan | 355/219 |
| 55-111954 | 8/1980 | Japan | 355/219 |
| 60-208775 | 10/1985 | Japan | 355/219 |
| 61-205962 | 9/1986 | Japan . | |
| 62-177570 | 8/1987 | Japan . | |

*Primary Examiner*—Fred L. Braun

[57] ABSTRACT

A brush type charging unit having a constant-current regulated power supply for supplying a constant current to a moving photosensitive medium through a conductive brush fiber contacting the moving photosensitive medium for charging the photosensitive medium uniformly such that the charged potential varies within a range smaller than 10 V when an atmospheric condition changes from 5° C.-20% RH to 35° C.-80% RH The constant-current regulated power supply has a pulse removing circuit for charging the moving photosensitive medium uniformly even when a few pin-holes exist in the photosensitive medium. A fiber element has a resistance between $4.5\times10^{7}$ ohm and $1\times10^{13}$ ohm when the fiber element has 1 denier in size and 1 mm in length, for charging the photosensitive medium and avoiding burning of the fiber element.

18 Claims, 18 Drawing Sheets

FIG. 15
PRIOR ART
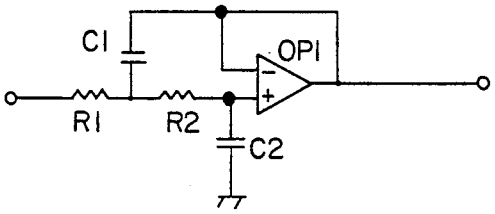
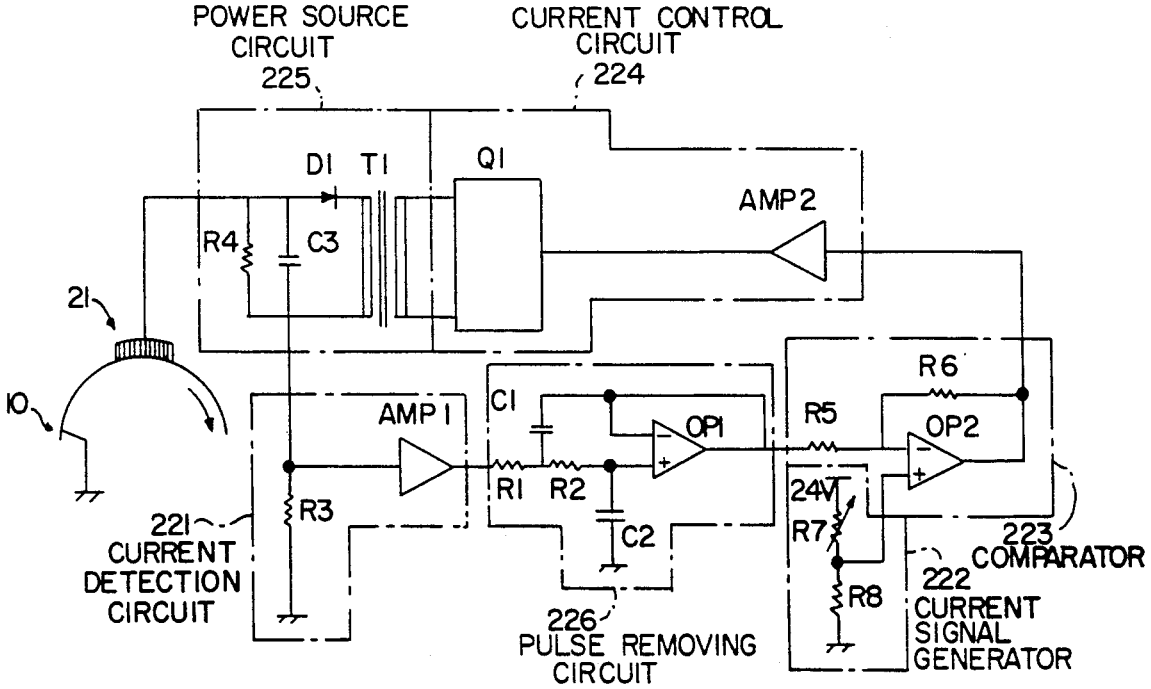
FIG. 16

BRUSH CONTACT TYPE CHARGING UNIT IN AN IMAGE FORMING APPARATUS

BACKGROUND OF THE INVENTION

1. Field of the Invention

The present invention relates to a brush contact type charging unit of an image forming apparatus. The brush contact type charging unit comprises a brush charger and a constant-current regulated power supply for the brush charger. The present invention particularly relates to the constant-current regulated power supply.

2. Description of the Related Art

An image forming apparatus is an apparatus such as an electrophotographic duplicating apparatus or printer. In the image forming apparatus, an electric image signal is converted to a toner image formed on an image forming medium and recorded on a recording sheet by transferring the toner image onto the recording sheet. In forming the toner image onto the surface of the image forming medium, the following process is performed: (1) the surface of the image forming medium is first charged uniformly by an electrostatic charging unit; (2) an optical signal obtained by converting the electric image signal is irradiated on the uniformly charged surface of the image forming medium thereby, producing a latent image on the image forming medium; and (3) the toner image is produced by developing the latent image.

In the above process, the electrostatic charging unit is very important for forming a high quality toner image onto the image forming medium. This is because, the quality of the toner image depends on the uniformity of the charge on the image forming medium.

There are three types of electrostatic charging units, namely corona discharging type, a roll contact type and a brush contact type. In the three types, however, the brush contact type charging unit, which will be simply called the "brush type charging unit" hereinafter, has come to be widely used. This is because the corona discharging type and roll contact type charging units have the following problems. The corona discharging type charging unit charges the image forming medium by performing corona discharging through an air gap, so that it requires a high voltage such as several thousands volts. Therefore, a large size and a high cost are required for the power supply. Furthermore, the usage of the high voltage produces ozone which shortens the life of the image forming medium. The roll contact type charging unit charges the image forming medium by using a roll made of an electroconductive elastic roll material attached to the surface of the image forming medium and rotated with the movement of the medium. The roll contact type charging unit also has a problem concerning uniformity of the charge on the image forming medium. Dust in the image forming apparatus is easily stuck to the roll material, producing dusty zones in places on the surface of the roll material, and the dusty zones are difficult to remove. Therefore, even though the roll contact type charging unit can use a low power supply voltage such as one thousand volts, the uniformity of the charge on the image forming medium is difficult to maintain because of the dusty zones. In the brush type charging unit, the dust problem does not occur. In the brush type charging unit, the image forming medium is charged by the brush charger consisting of a plurality of brush fibers arranged transversely and perpendicularly to the moving direction of the image forming medium, and attached to the surface of the image forming medium. The brush type charging unit charges the image forming medium under a low power supply voltage as in the roll contact type charging unit and has no problem of uniformity due to the dust as in the roll contact type charging unit.

Recently, the size of the image forming apparatus has become compact. Therefore, the size of the image forming medium also becomes small, so that a high charging speed is required between the image forming medium and the charging unit if the same desirable recording speed is kept. However, it becomes hard to keep good uniformity when the charging speed increases because the charging current at an initial period of transient charging is easily changed by an external cause. Accordingly, even in the brush type charging unit there is a problem of maintaining good uniformity of the charge on the image forming medium.

In the contact type charging unit such as the roll contact type or the brush contact type charging unit, the uniformity of the charge on the image forming medium strongly depends on the atmosphere, particularly relative humidity, around the charging unit, when a constant-voltage regulated power supply is used in the contact type charging unit. In the roll contact type charging unit, the dependence of the uniformity on the humidity has been studied in Japanese laid-open patent application TOKUKAISHO 56-132356 to Doi et al. of Sept. 12, 1986. According to Doi, less affect on uniformity by humidity is improved by applying a constant-current regulated power supply to the roll contact type charging unit instead of the usual constant-voltage regulated power supply. Doi teaches that the uniformity can be improved by applying the constant-current regulated power supply to the roll contact type charging unit. However Doi teaches nothing concerning the brush type charging unit. Incidentally, the problem of uniformity due to the dusty zones is not solved in Doi.

When the contact type charging unit uses the constant-current regulated power supply, the uniformity of the charge on the image forming medium is deteriorated by pin-holes in the image forming medium. Generally, the image forming medium is a photosensitive layer formed on a metal substrate by dipping the metal substrate into liquid photosensitive material. Therefore, from a view point of cost performance, it must be assumed that a few pin-holes will appear in the photosensitive layer because of very small air bubbles having been produced during the dipping. In the pin-hole, the metal substrate is exposed even though the size of the pin-hole is very small. Therefore, the problem of the uniformity of the charge due to the pin-holes usually occurs in the case of the contact type charging unit, particularly in the case of the brush type charging unit. In Doi, the problem due to the pin-holes is discussed; however the pin-holes discussed in Doi are quite different from those mentioned above. The pin-holes in Doi are those produced by electrical break down between the surface of the image forming medium and the roller due to a high electric field.

The constant-current regulated power supply has also been applied to the corona discharging type charging unit. This is disclosed in Japanese Patent publication 62-11345 to Suzuki et al. in Mar. 12, 1987. According to Suzuki, the uniformity of the charge on the image forming medium is also influenced by variation in humidity. This problem of the uniformity can be improved by applying the constant-current regulated power supply to the corona discharging type charging unit instead of the usual constant-voltage regulated power supply. However, Suzuki teaches nothing relating to the present invention because the constant-current regulated power supply in Suzuki is a very high voltage (several tens thousand volts) power supply and the charging mechanism of Suzuki is quite different from that of the present invention.

SUMMARY OF THE INVENTION

An object of the present invention, therefore, is to improve the brush type charging unit in the image forming apparatus so that the image forming medium is charged uniformly independent of the humidity around the image forming apparatus.

Another object of the present invention is to improve the brush type charging unit so that the image forming medium is uniformly charged independent of the pin-holes distributed in the image forming medium.

Yet another object of the present invention is to improve the brush type charging unit having a low production cost so that the image forming medium can be charged uniformly independent of the humidity around the image forming apparatus and of the pin-holes distributed in the image forming medium.

A further object of the present invention is to improve the brush type charging unit so that the image forming medium can be charged uniformly independent of the humidity around the image forming apparatus and of the pin-holes distributed in the image forming medium without enlarging the size and the weight of the image forming apparatus.

The above objects are accomplished by providing a constant-current regulated power supply to the brush type charging unit instead of a constant-voltage regulated power supply used in the prior art, and the above objects particularly concerning the pin-holes are accomplished by providing a pulse removing circuit to the constant-current regulated power supply.

According to the inventor's study of the relationship between the uniformity of the charge on the image forming medium and the humidity around the image forming apparatus having a brush type charging unit, the uniformity is strongly affected by the humidity. At the beginning, it was considered that this phenomenon appeared probably due to the brush fiber's resistance influenced by the humidity. However; it was found by experiment that this consideration was not correct. After further study of the phenomenon, it has been concluded that the phenomenon appeared because of variation of the threshold voltage of discharge from the ends of the brush fibers to the surface of the image forming medium due to atmospheric condition.

It was believed before that the charging currents flowing through the brush fibers were merely contact currents flowing through the touched portion of the brush fibers to the surface of the image forming medium. However, it has now been concluded that a discharging current, flowing from portions in proximity to the ends of the brush fibers and the surface of the image forming medium, is included in the charging current so as to be rather dominant and easily influenced by the humidity. When the power supply is a constant-voltage regulated type as in the prior art, the charging current through the brush fibers is easily varied by the change of the humidity, resulting in changing the quantity of charge at the image forming medium. This problem is solved by applying the constant-current regulated power supply to the brush type charging unit instead of the constant-voltage regulated power supply. However, when the constant-current regulated power supply is applied, a new problem due to the pin-holes has occurred. Since the charging current flowing through the brush fibers is regulated constantly, when there is a pin-hole and the brush fibers touch the pin-hole, the current flowing through the pin-hole becomes dominant in the charging current at this time, so that the currents flowing through other brush fibers, not touching the pin-hole, become little. This causes production of a poorly charged striped area on the image forming medium along a length direction of the brush charger. Incidentally, in the case of using the constant-voltage regulated power supply, the charging voltage is kept constant even though most of the charging current flows through the pin-hole, so that the problem of producing such stripes does not occur. This problem is solved by introducing a pulse current removing circuit into the constant-current regulated power supply.

BRIEF DESCRIPTION OF THE DRAWINGS

FIG. 15' is a circuit diagram for a conventional low pass filter circuit for removing pulse signals;

FIG. 16' is a circuit diagram of the constant-current regulated power supply including the pulse removing circuit for the brush type charging unit;

FIG. 17'(*b*) is an equivalent circuit for the charging model illustrated in FIG. 17(*a*);

DESCRIPTION OF THE PREFERRED EMBODIMENTS

Before describing the preferred embodiments of the present invention, the constitution of a typical image forming apparatus including a brush type charging unit will be described with reference to FIG. 1. A charging situation of the brush type charging unit onto the image forming medium will be explained with reference to FIGS. 2, 3 and 4. The dependence on humidity, for prior art image forming apparatus, of the discharging threshold voltage and the charged potential at the surface of the image forming medium will be discussed with reference to FIG. 5.

Figure 1:
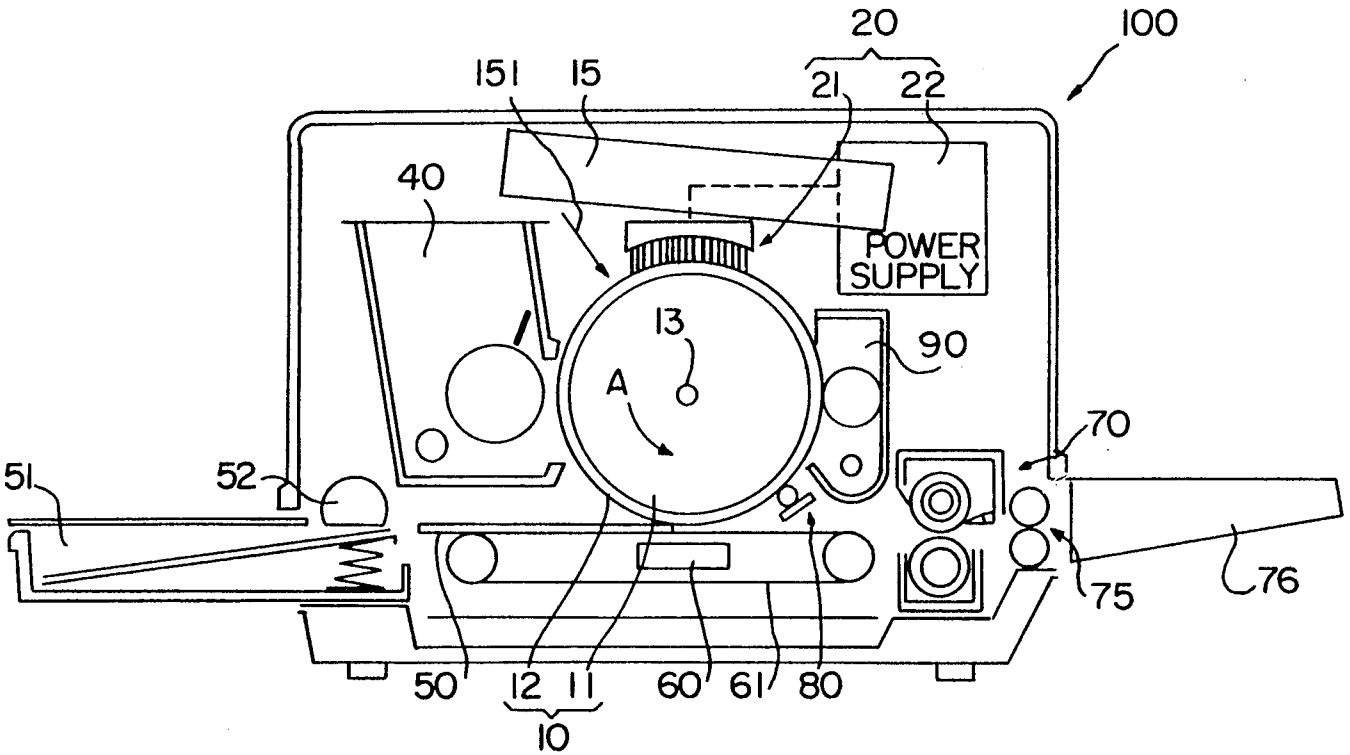
FIG. 1' is a side view illustrating the internal constitution of an image forming apparatus.

FIG. 1 illustrates the constitution of a typical image forming apparatus 100 including a brush type charging unit 20. In FIG. 1, an electrical image signal is input to the image forming apparatus and converted to a visual image recorded on a recording sheet. This process is performed as follows (1) an image forming drum 10, which is the image forming medium having been described so far and will be simply called a "drum 10" hereinafter, and which consists of a metal cylinder 11 and a photosensitive layer 12 covering the metal cylinder 11, is rotated around a drum axis 13 as shown by an arrow A; (2) the rotated layer 12 is electrostatically charged by a brush type charging unit 20 consisting of a brush charger 21, which directly contacts the surface of the rotated layer 12, and a power supply 22 for applying a charging voltage to the brush charger 21; (3) an electric image signal to be recorded is given to an electric unit 15 in which the electric image signal is converted to an optical image signal and the optical image signal is irradiated at point 151 on the surface of the charged layer 12 through an optical beam scanned in a plane parallel to the drum axis 13, thereby producing a latent image on the surface of the charged layer 12; (4) the latent image is developed by a developing unit 40, producing a toner image on the rotating layer 12; (5) meanwhile, a recording sheet 50 is fed from a sheet cassette 51 to an image transfer unit 60 by a pick up roller 52 and a rotated belt 61 and the toner image on the rotating layer 12 is transferred onto the recording sheet 50 by the image transfer unit 60; (6) the recording sheet 50 is passed through the image transfer unit 60 and sent to a fixing unit 70 in which the toner image transferred on the recording sheet 50 is fixed; (7) the recording sheet 50 having the fixed toner image is sent to a sheet stacker 76 by a sending roller 75, (8) meanwhile, the charge left on the layer 12 after the image transfer is extinguished by an erasing unit 80; (9) the toner left on the layer 12 is cleaned by a cleaning unit 90; and (10) then the layer 12 is charged by the brush charger 21 to perform the next image recording.

Figure 2:
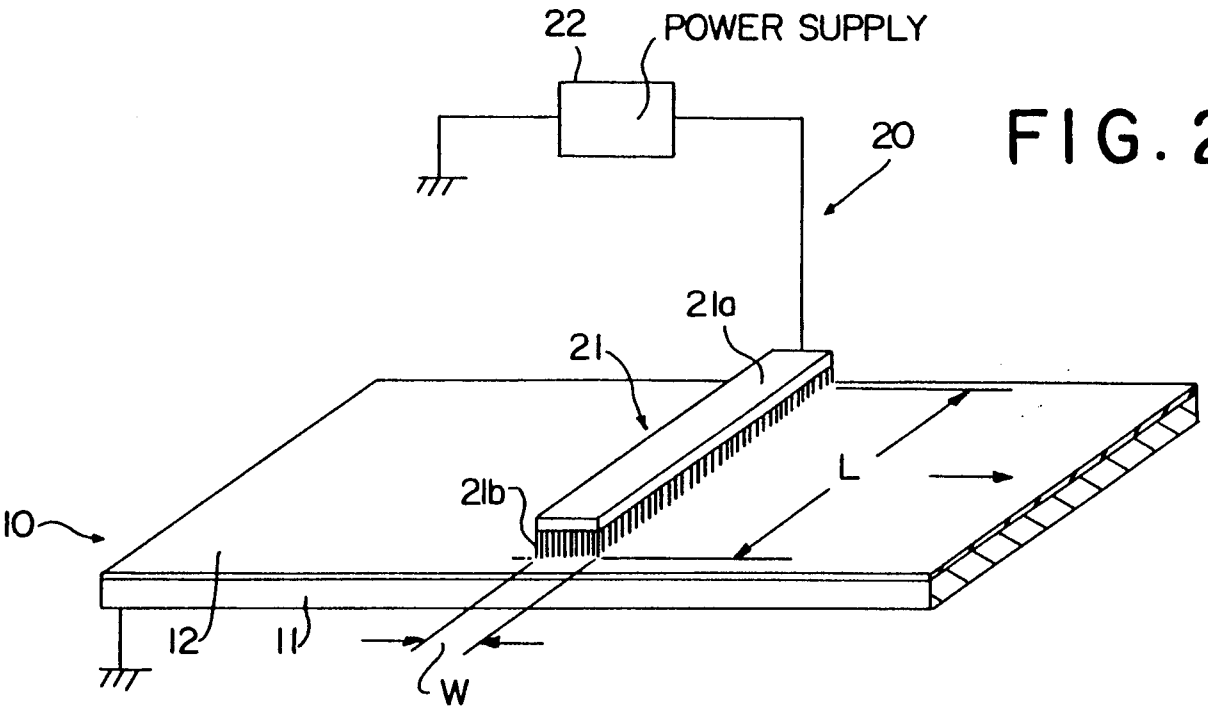
FIG. 2' is a perspective view illustrating a brush type charging unit operating with an image forming medium.

FIG. 2 is a perspective view illustrating the brush charger 21 electrostatically charging the image forming medium (photosensitive layer 12) moving in a direction indicated by an arrow. In FIG. 2, the same reference numbers as in FIG. 1 designate the same units or parts as in FIG. 1, and the drum 10 is depicted as a stretched board. The charging voltage from the power supply 22 is applied to the surface of the photosensitive layer 12 through the brush charger 21, so that the layer 12 is charged. The brush charger 21 consists of a conductive base 21*a* and conductive brush fibers 21*b* connected on the base 21*a*, such as by using conductive glue. The brush fibers 21*b* are provided above the surface of the layer 12 so that the tips of the brush fibers 21*b* touch the surface of the layer 12. The brush fibers 21*b* are formed so as to have a length L nearly equal to the width of the layer 12 and a width W which is determined in consideration of the uniformity of the charge on the layer 12. As mentioned before, it is desired to make the image forming apparatus compact, so that the layer 12 must be moved fast to maintain the usual rate of the image recording. This results in producing the problem of the uniformity of the charge on the image forming medium if the power supply is the constant-voltage regulated type as in the prior art. In the present invention, the power supply 22 is the constant-current regulated type, so that the problem of the uniformity is solved.

Figure 3:
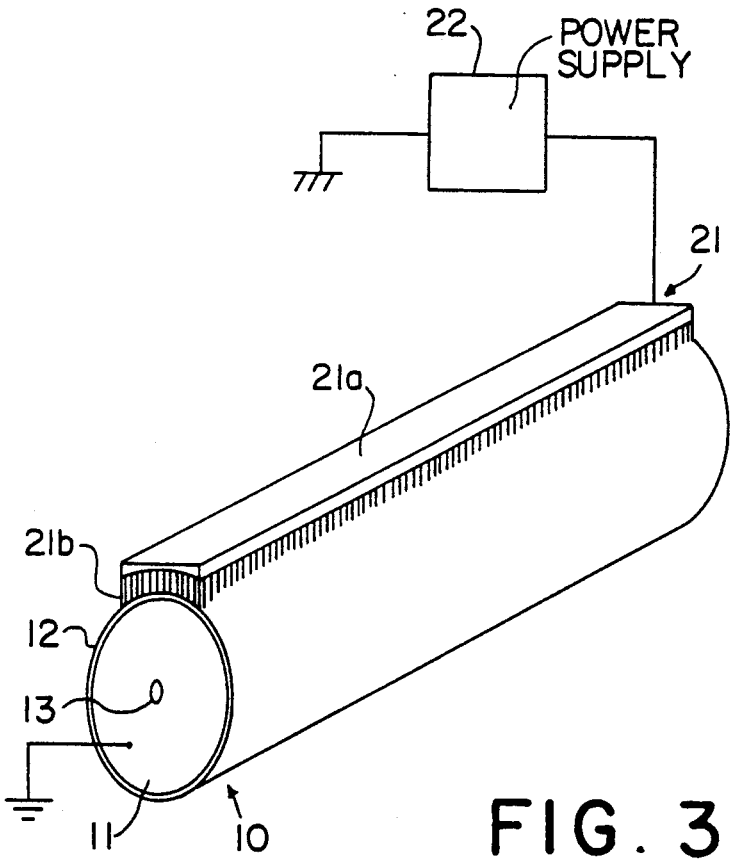
FIG. 3' is a perspective view illustrating a brush type charging unit operating with a photosensitive drum.
Figure 4:
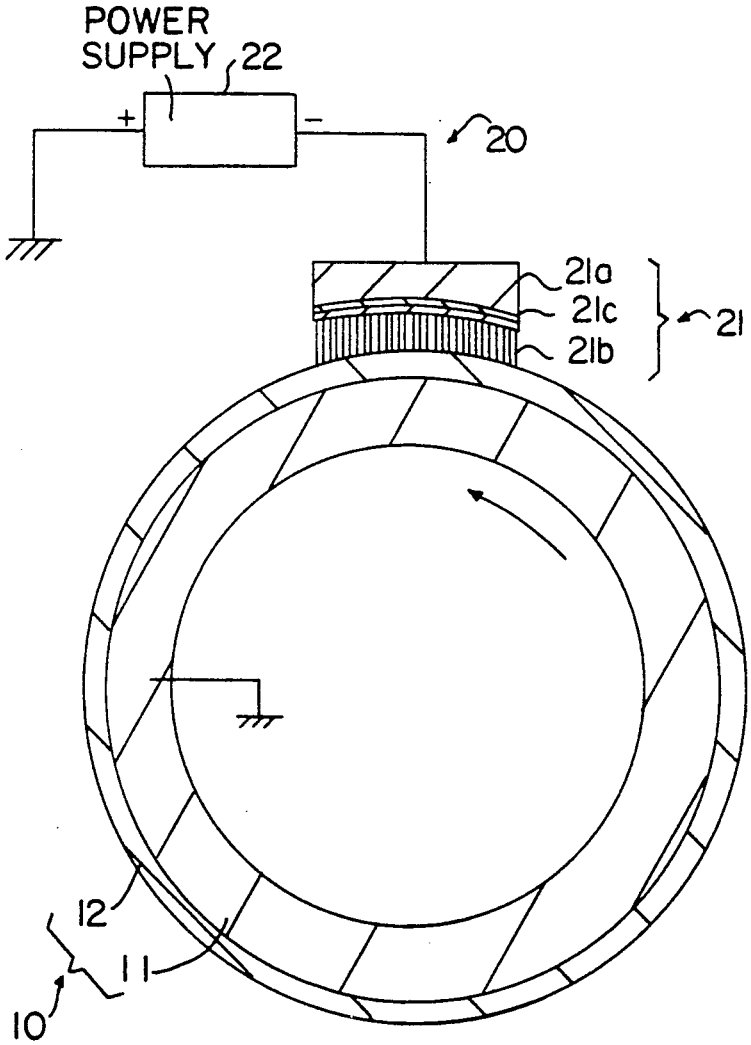
FIG. 4' is a cross-sectional view illustrating a brush charger of a brush type charging unit operating on the photosensitive drum.

FIG. 3 is a perspective view of the brush charger 21 provided on the drum unit 10. In FIG. 3, the same reference numbers as in FIG. 2 designate the same units or parts as in FIG. 2. FIG. 4 is a cross-sectional view of the brush charger 21 and the drum 10 on which the brush charger is set. In FIG. 4, the same reference numbers as in FIG. 2 designate the same units or parts as in FIG. 2. In the embodiment of FIG. 4, the brush fibers 21*b* are attached onto the conductive base 21*a* by a conductive glue 21*c*. A base of the brush fibers 21*b* is made into a textile from which the brush fibers are grown, so that the brush fibers 21*b* can be easily connected to the conductive base 21*a* by pasting the textile part onto the conductive base 21*a*, using the conductive glue 21*c*.

Figure 5:
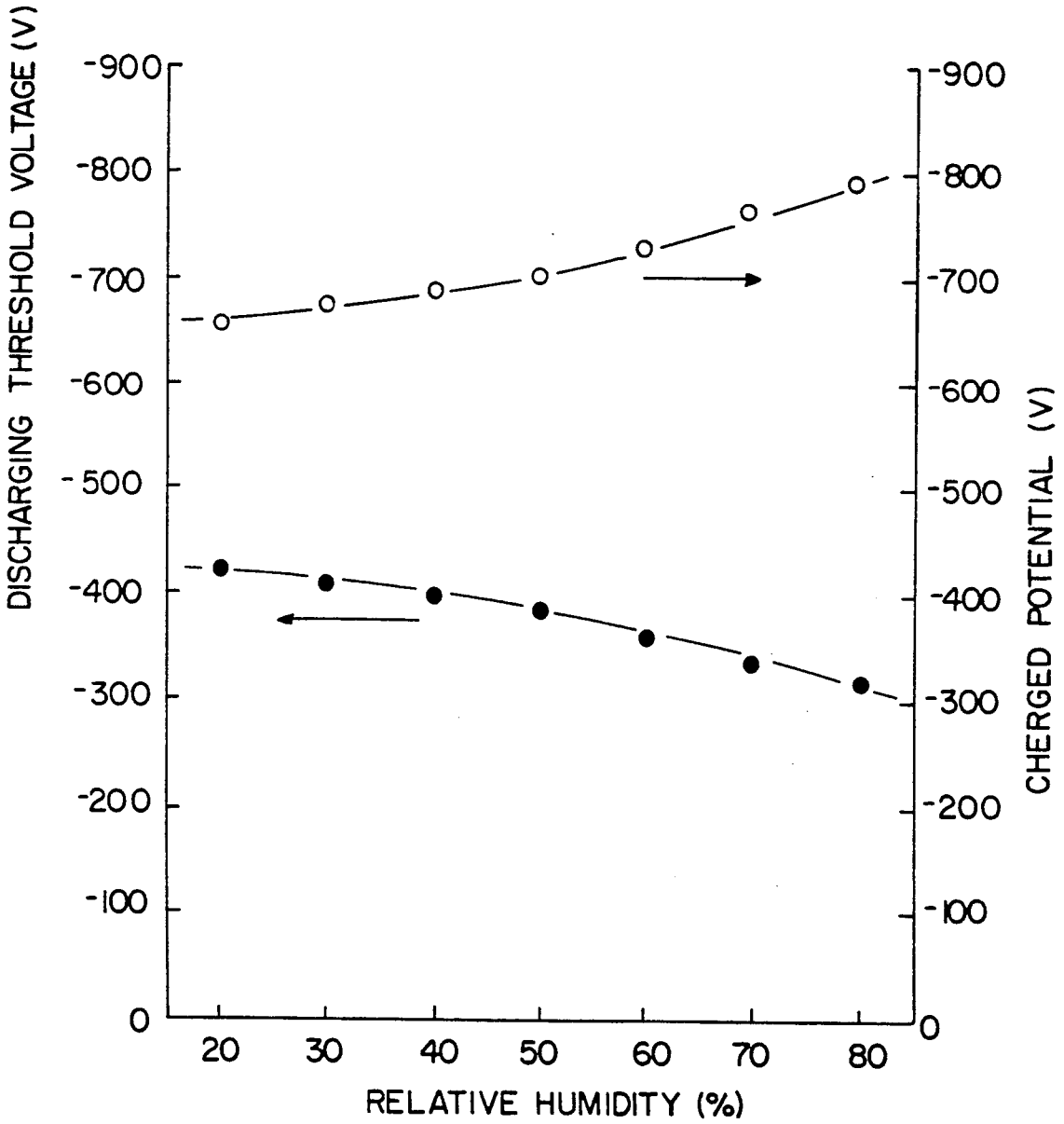
FIG. 5 PRIOR ART
FIG. 5' is a graph showing the variations of the discharging threshold voltage and the charged potential at the image forming medium, in response to the change of the relative humidity, occurring in prior art image forming apparatus.

In the case of using the constant-voltage regulated power supply as in the prior art apparatus, the dependence on the humidity, of that of the discharging threshold voltage applied between the brush charger 21 and the drum 10 and that of the charged potential at the surface of the drum 10 are shown respectively by curves of solid circles and of the white circles in FIG. 5. From the solid circle curve for the discharging threshold voltage and the white circle curve for the charged potential, it can be seen that the discharging threshold voltage varies approximately 100 volts (V) and the charged potential varies approximately 150V respectively, when the relative humidity changes from 20% to 80%.

Figure 6:
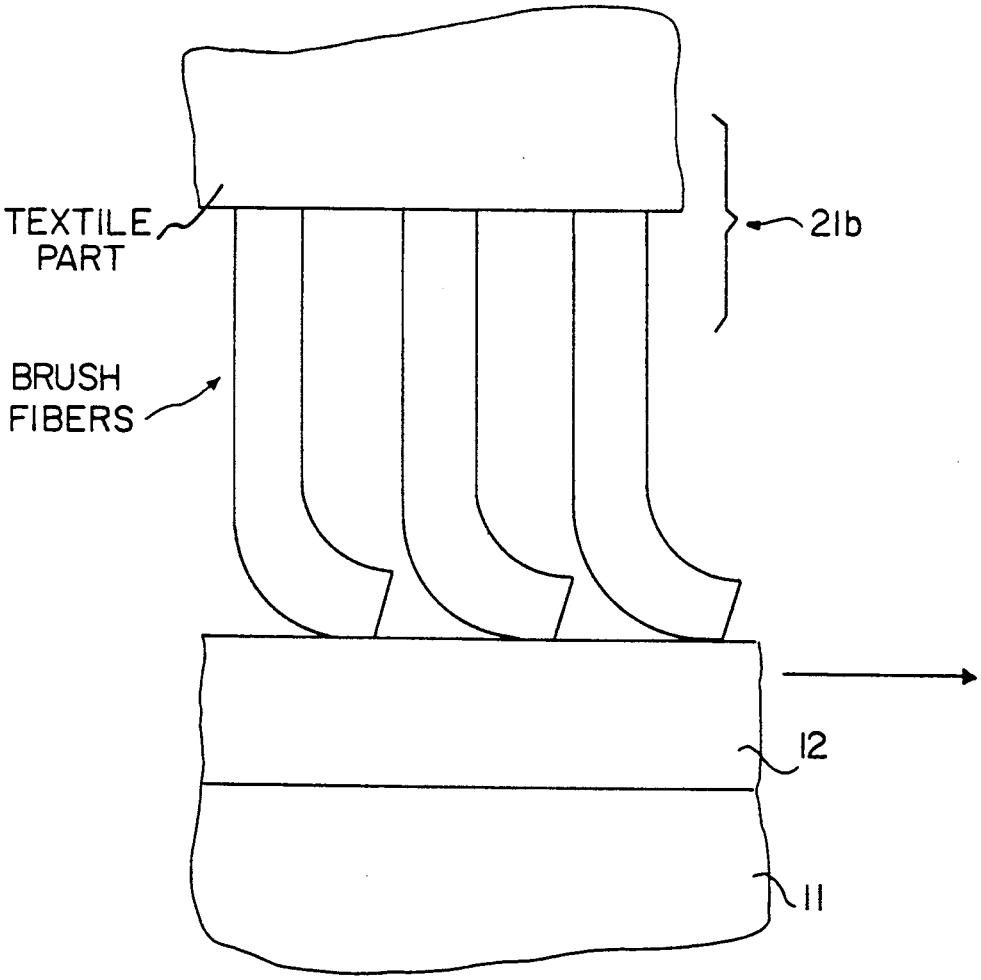
FIG. 6' is a side view of the contact area of the brush charger and the image forming medium for illustrating the discharging current and the contact current flowing through the brush charger.

After the study of the charging current flowing to the photosensitive layer 12 through the brush charger 21, it is concluded that there must be three new matters of the charging current as follows: (1) the charging current consists of a contact current (c1) flowing through contact portions of the brush fibers 21b to the surface of the photosensitive layer 12 and a discharging current (c2) flowing from the end portions of the brush fibers 21b to the surface of the photosensitive layer 12; (2) the discharging current is dominant, compared with the contact current; and (3) the discharging current is easily influenced by the humidity. The flow of the contact current c1 and the discharging current c2 around the ends of the brush fibers 21b in contact with the surface of the photosensitive layer 12 is illustrated in FIG. 6. In FIG. 6, the same numbers as in FIG. 4 designate the same parts as in FIG. 4, and the brush fibers 21b are bent respectively because of the movement of the drum 10 as shown by an arrow in FIG. 6. If the existing discharging current c2 is dominant and is easily influenced by the humidity, the problem as to the uniformity of the charge on the photosensitive layer 12 can be easily appreciated. That is, when the constant-voltage regulated power supply is used as in the prior art apparatus, the discharging current c2 continues to flow and varies in response to the humidity even though the brush fibers 21b are protected from the humidity. This variation of the discharging current due to the humidity can be improved by changing the power supply to the constant-current regulated power supply.

Three embodiments of the present invention will be described with reference to FIGS. 6 to 19.

Figure 7:
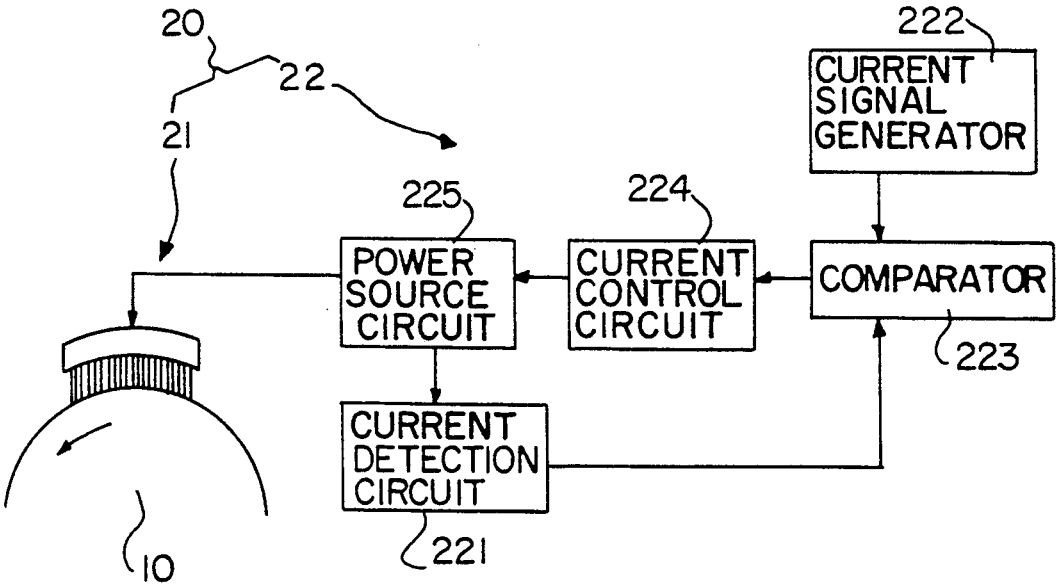
FIG. 7' is a block diagram of the constant-current regulated power supply for the brush charger.

A block diagram of a first embodiment of a constant-current regulated power supply, for the brush type charging unit in accordance with the invention is shown in FIG. 7. In FIG. 7, the same reference numbers as in FIG. 3 designate the same units or parts as in FIG. 3. The constant-current regulated power supply 22, which will be simply called the "power supply 22" hereinafter, supplies a constant current of approximate 20 micro amperes ($\mu$A) to the brush charger 21, changing an output voltage of the power supply 22 from 0 to $-2$ kV.

The power supply 22 has the following function: the constant current to the brush charger 21 is directly output from a high voltage power source circuit 225; the constant state of the output current from the circuit 225 is detected by a current detection circuit 221, producing a detected current signal; the detected current signal is fed to a comparator 223 in which the detected current signal is compared with a standard current signal generated by a standard current signal generator 222, producing a difference signal; and the difference signal is fed to a current control circuit 224 by which the current output from the high voltage power source circuit 225 is controlled so as to make the difference signal zero.

Figure 8:
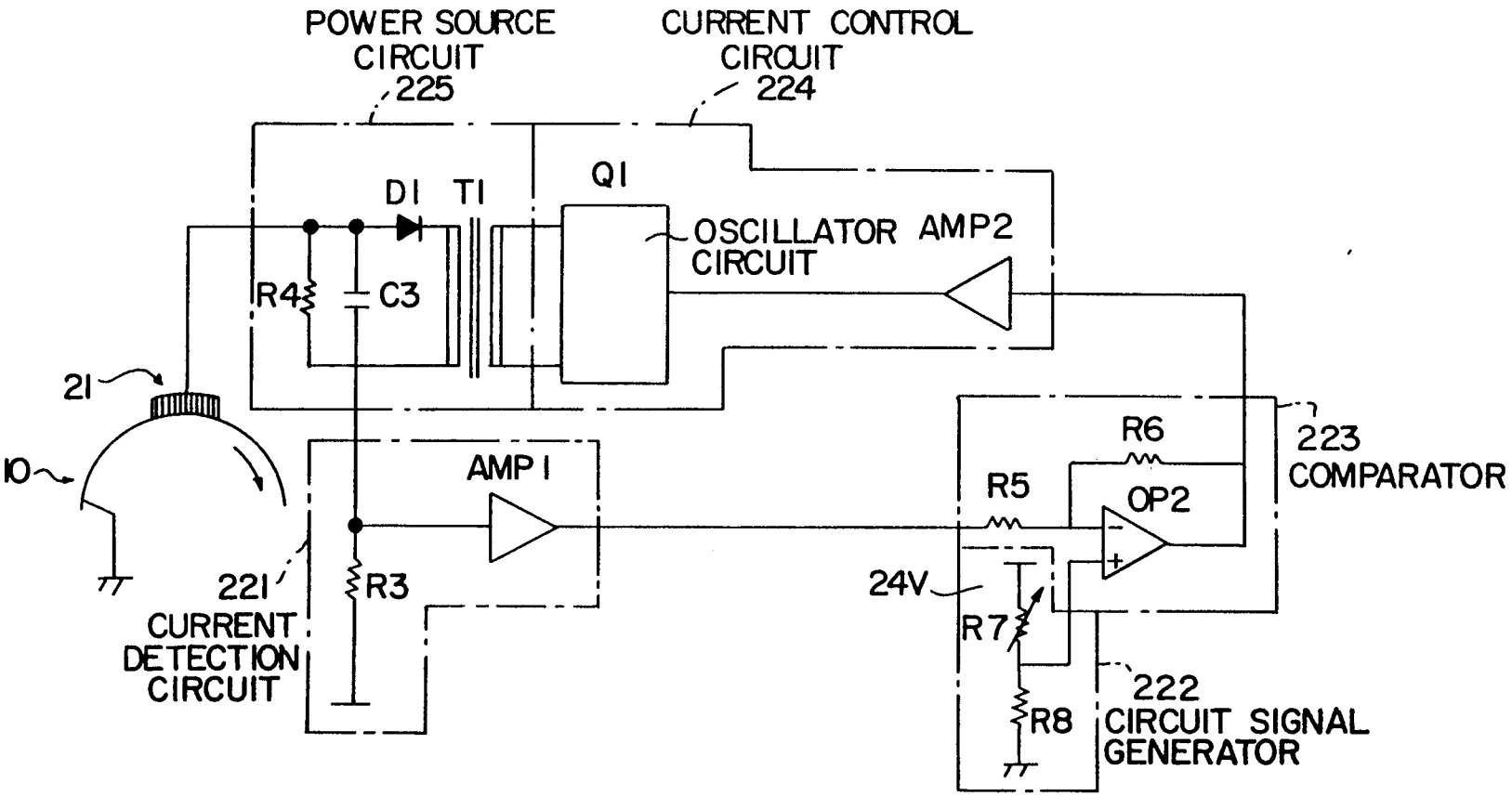
FIG. 8' is a circuit diagram of the constant-current regulated power supply for the brush charger.

The detailed circuit of the constant current power supply firstly embodying the present invention is shown in FIG. 8. In FIG. 8, the same reference numbers as in FIG. 7 designate the same parts of units in FIG. 7. In FIG. 8, the state of the charging current flowing through the brush charger 21 is detected by a resistor R3 and amplified by an amplifier AMP1, producing the current detection signal. The resistor R3 and the AMP1 constitute the current detection circuit 221. The output from the AMP1 in the current detection circuit 221 is sent to an inverting input terminal of an operational amplifier OP2 through a resistor R5 in the comparator 223. On the other hand, the standard voltage is determined by the standard current signal generator 222 consisting of a variable resistor R7, a fixed resistor R8 and a standard voltage generator not depicted in FIG. 8, and sent to a noninverting input terminal of the OP2. These two input voltages to the OP2 are compared by using the OP2, the resistor R5 and a resistor R6 in the comparator 223, producing a comparator output between the two input voltages. The comparator output from the comparator 223 is amplified by an amplifier AMP2 and input to an oscillator circuit Q1 in the control circuit 224. The output of Q1 is sent to a primary circuit of a high voltage transformer T1 in the high voltage power source circuit 225. A secondary circuit of the high voltage transformer T1 is a rectifying circuit consisting of a diode D1, a condenser C3 and a resistor R4 for generating a d.c. voltage of 1,500V. Thus, the d.c. voltage is generated under the regulation based on the standard current signal from the standard current signal generator 222 and supplied to the brush charger 21.

Figure 9:
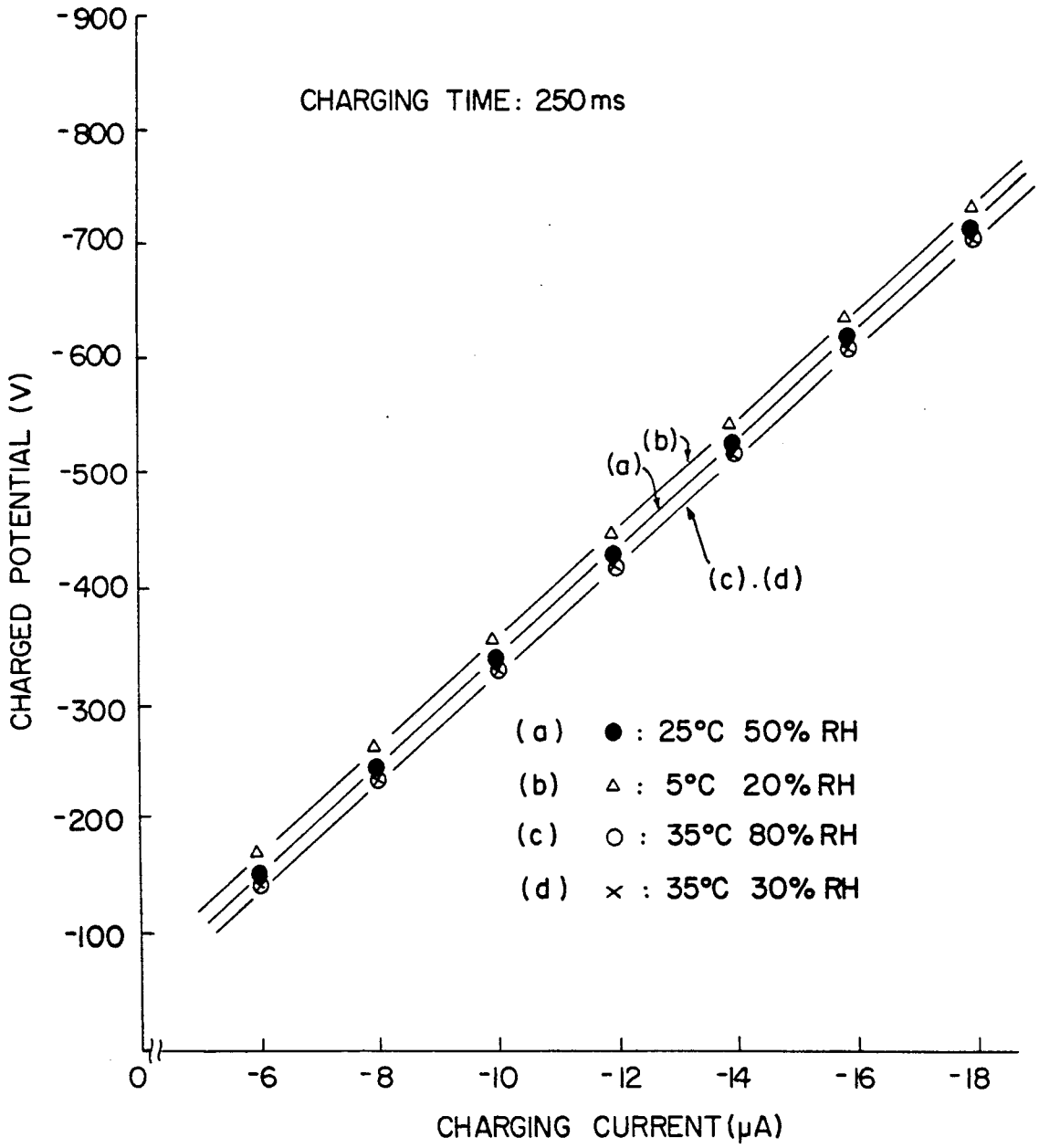
FIG. 9' is a graph showing the relationship between charged potential of a photosensitive drum and charging current derived by the constant-current regulated power supply for the brush charger, under several kinds of atmospheric conditions and a charging time of 250 ms.
Figure 10:
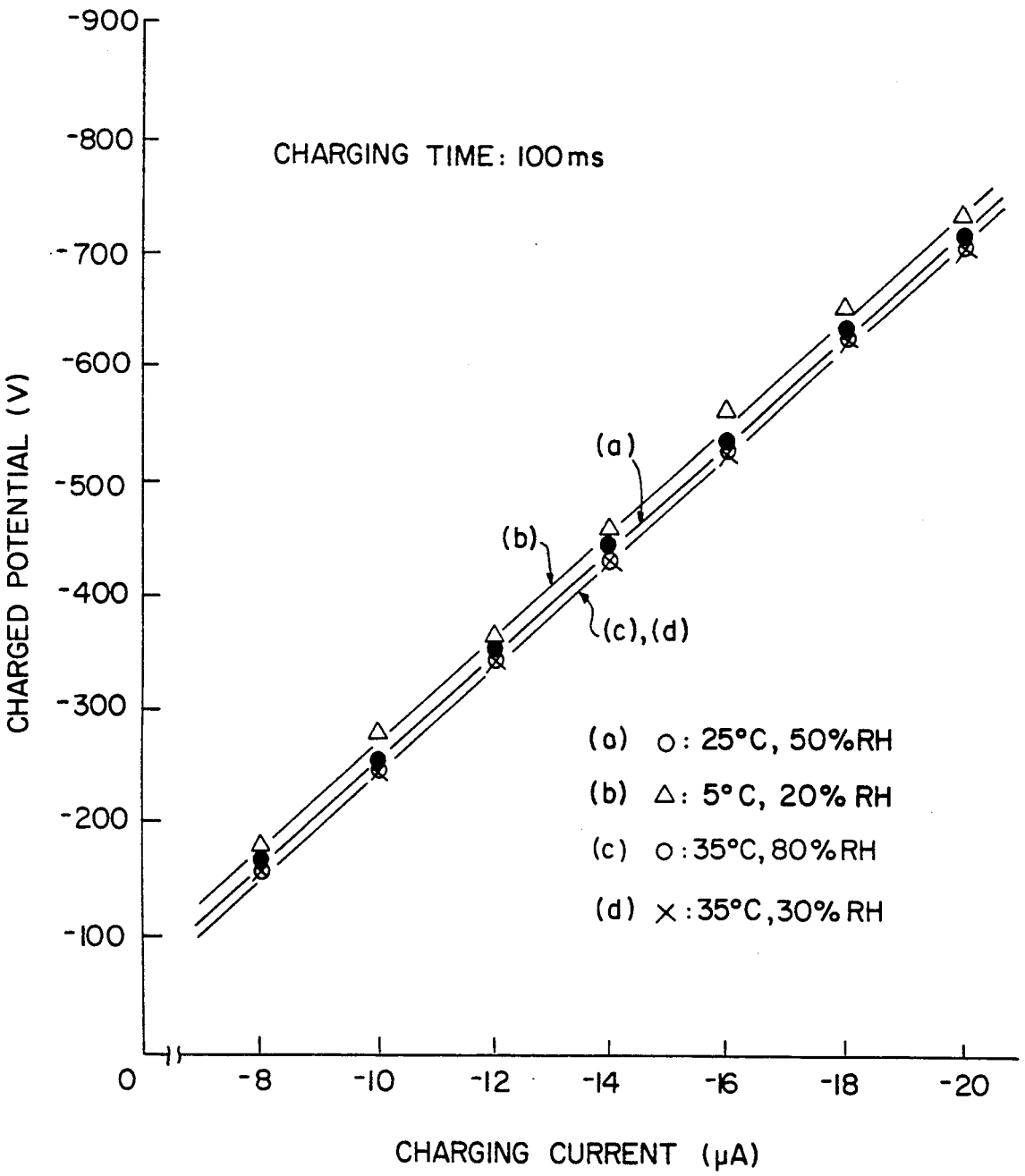
FIG. 10' is a graph showing the relationship between charged potential of a photosensitive drum and charging current derived by the constant-current regulated power supply for the brush charger, under several kinds of atmospheric conditions and a charging time of 100 ms.

The potential at the surface of the charged drum 10 is measured by a surface potential meter. FIGS. 9 and 10 show the measurement results obtained by changing the charging current flowing through the brush charger 21 from 0 to 20 $\mu$A under the various conditions of temperature and relative humidity (RH). In FIGS. 9 and 10, curves (a), (b), (c) and (d) made respectively by plotting solid circles, triangles, white circles and "x" marks are obtained respectively under the conditions of 25° C. and 50% RH, 5° C. and 20% RH, 35° C. and 80% RH, and 35° C. and 30% RH. In FIG. 9, the width of the brush charger 21 is 15 mm and a linear velocity of the drum 10 at the surface is 60 mm/s, so the charging time becomes 250 ms. In FIG. 10, the width of the brush is 6 mm and a linear velocity of the drum 10 is 60 mm/s, so the charging time becomes 100 ms.

Figure 11:
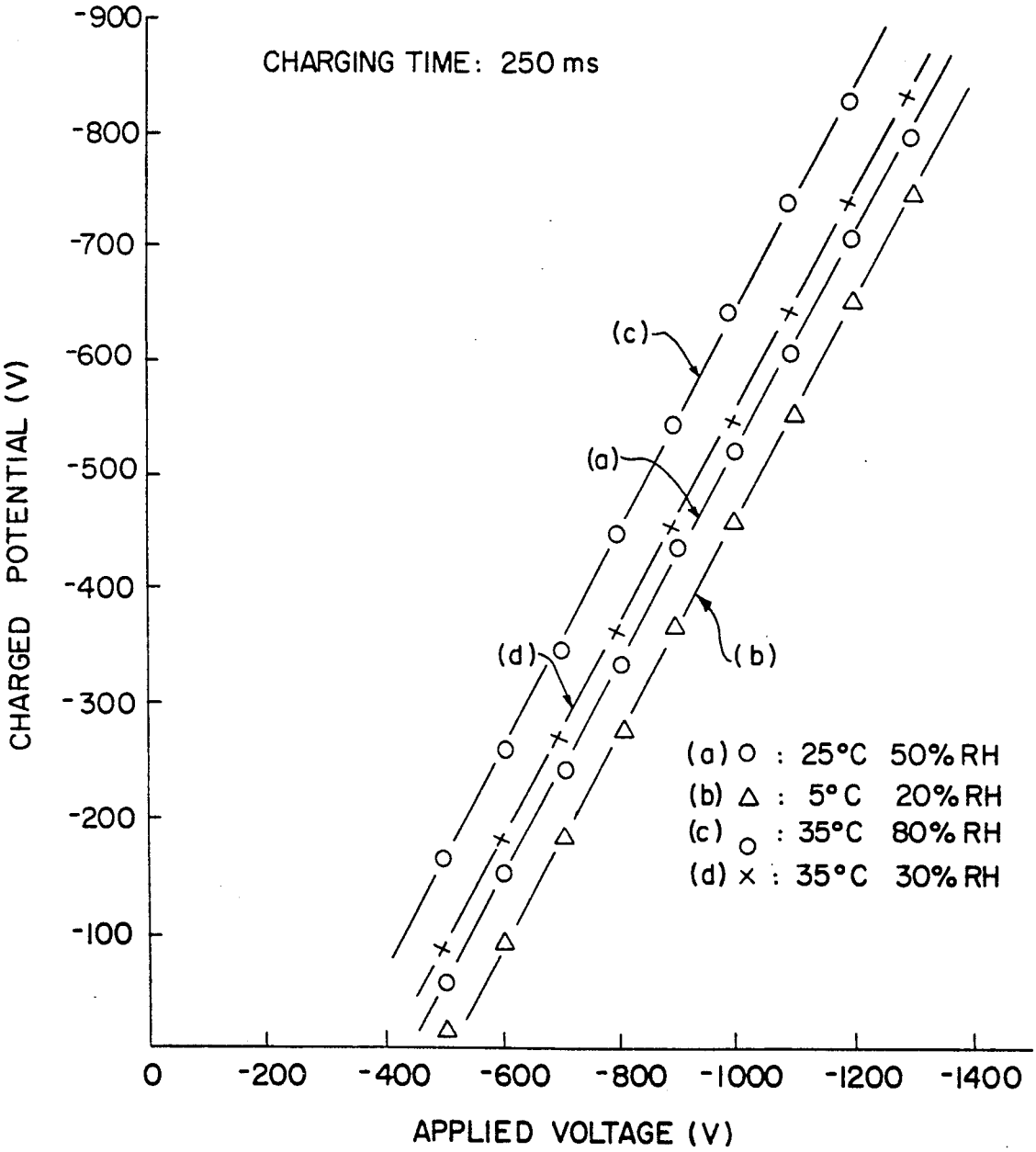
FIG. 11' is a graph showing the relationship between charged potential of a photosensitive drum and applied voltage derived by the constant-voltage regulated power supply for the brush charger, under several kinds of atmospheric conditions and a charging time of 250 ms.

Under the same atmospheric conditions of those in FIG. 9 or 10, the measurement results of the charged potential in the case of using the constant-voltage regulated power supply are shown in FIG. 11, changing applied voltage onto the brush charger 21 instead of the charging current. Comparing the measurement results in FIG. 9 or 10 with that in FIG. 11, it will be understood that the influence of the ambient temperature and humidity on the charged potential is improved as much as 10 times or more. As shown in FIGS. 9 and 10, the difference of the charged potentials obtained from the curves (a), (b), (c) and (d) is within approximately 10V at any charging current, and as shown in FIG. 11, the difference of the charged potentials obtained from the curves (a), (b), (c) and (d) is within approximately 200V at any applied voltage.

Comparing FIGS. 9 and 10, the charged potential obtained from the curve (a), (b), (c) or (d) at any charging current in FIG. 9 is higher than that in FIG. 10. This is because of the difference of the charging times in FIGS. 9 and 10. However, the difference among the charged potentials obtained by the curves (a), (b), (c) and (d) at any charging current in FIG. 9 is approximately the same as that in FIG. 10 as mentioned above, which teaches that the charging time affects nothing in relationship to the influence of the ambient temperature and humidity on the charged potential.

Figure 12:
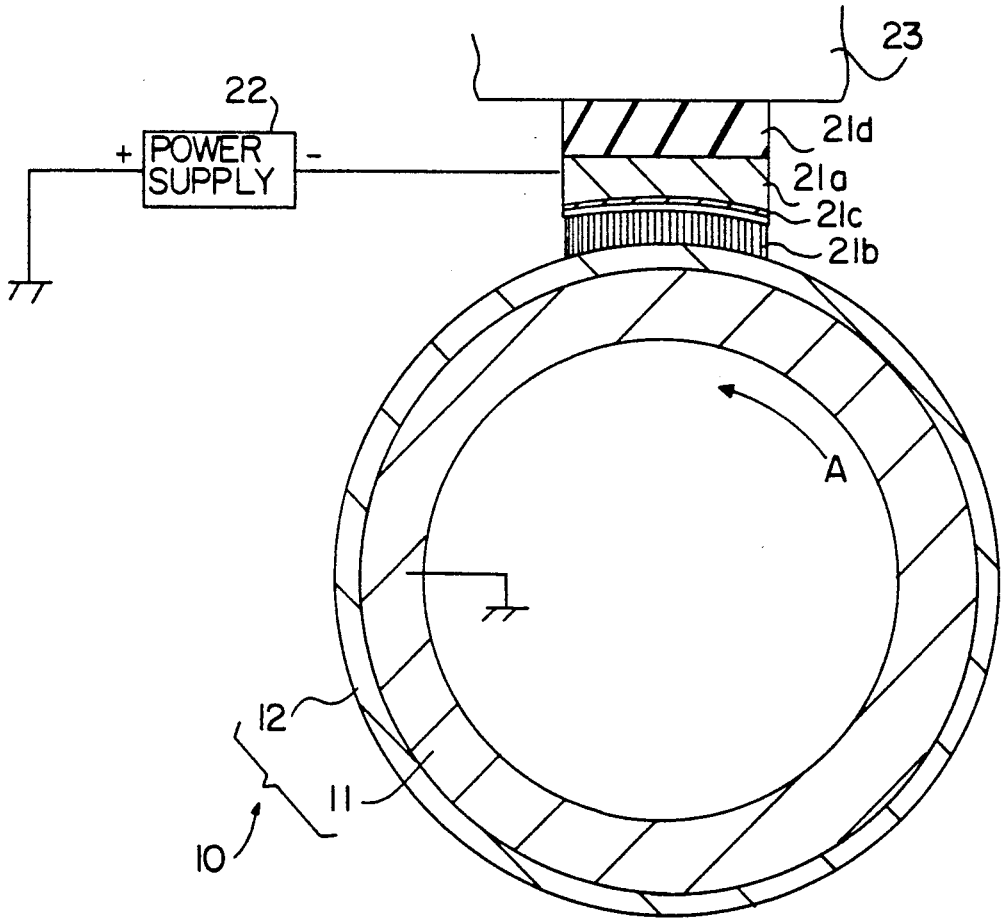
FIG. 12' is a cross-sectional view illustrating the brush charger, attached to the frame of the image foaming apparatus through an insulating block and operating on the photosensitive drum.
Figure 13:
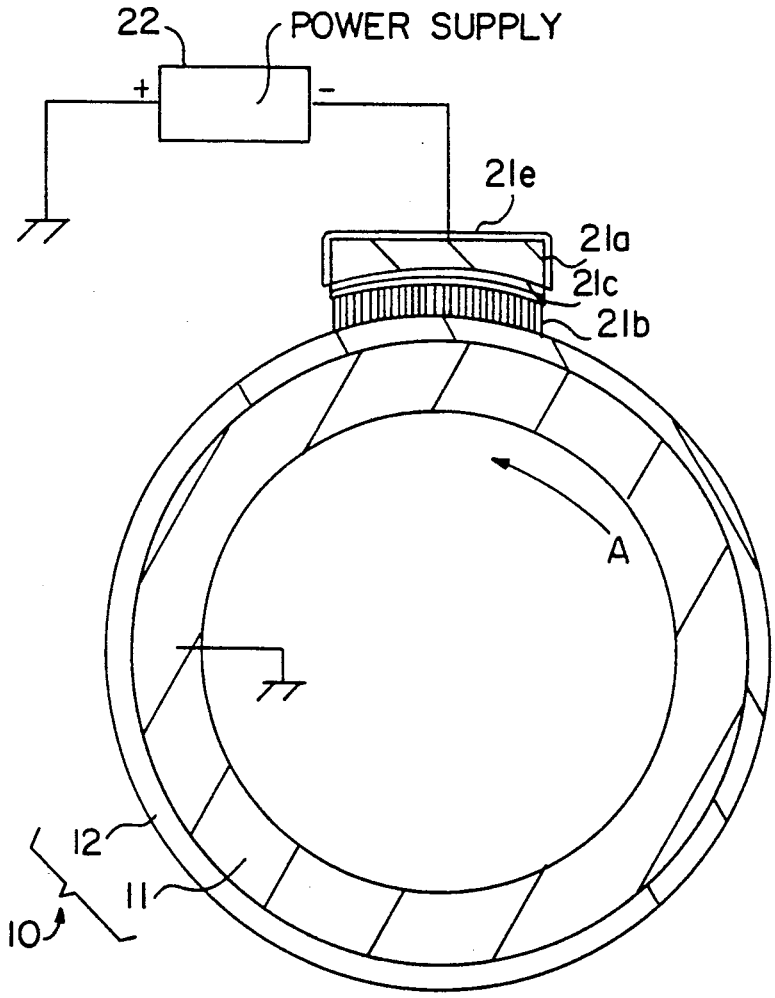
FIG. 13' is a cross-sectional view of the brush charger, including a brush base coated by an insulating layer, operating on the photosensitive drum.

In the brush type charging unit 20 including the constant-current regulated power supply 22, the electrical insulation of the brush charger 21 is very important for making the charging current constantly flow through the brush charger 21. FIGS. 12 and 13 show ways of how to obtain good insulation. In FIGS. 12 and 13, the same reference numbers as in FIG. 4 designate the same units or parts as in FIG. 4.

In FIG. 12, the brush charger 21 is fixed to a frame 23 by a support member 21*d* so as to be arranged in parallel to the central axis of the drum 10, making the brush fibers 21*b* touch the photosensitive layer 12. Negative high voltage of the constant-current regulated power supply 22 is applied to the photosensitive layer 12 through the aluminum brush base 21*a*, a conductive glue 21*c* and the conductive brush fibers 21*b*. When the support member 21*d* is made of polyamide resin, acrylonitrile-butadiene-styrene (ABS) resin or acrylic resin, the charged potential is decreased when the humidity around the brush type charging unit increases because of a leakage current flowing through the support member 21*d*. Namely, a surface resistance of the support member 21*d* made of the above material decreases under the high humidity. In this case, most of the charging current flows to the earth through the surface of the support member 21*d* instead of the brush fibers 21*b*, and this phenomena is escalated until the charging becomes impossible to be performed. This problem is improved by using fluororesin such as polytetrafluoroethylene (PTFE), epoxy resin or silicone resin.

In FIG. 13, another type of electrical insulation of the brush charger 21 is schematically shown. In this case, an epoxy resin layer 21*e* of 50μthickness is coated on the surface of the aluminum brush base 21*a*. This is an effective method of lowering the price because the conventional brush charger or a thin layer of resin can be used.

The second embodiment of the present invention for solving the problem of the pin-holes will be described below.

Generally, the photosensitive layer 12 of the drum 10 has several pin-holes, each having a diameter of less than 100 μm. At the pin-hole, the surface of the aluminum cylinder is bared because of a deficit of the photosensitive layer 12. When the brush fibers 21*b* touch the surface of the aluminum cylinder 11 at the pin-hole, the load circuit of the constant current regulated power supply is shorted. Then, the charging current is concentrated to the pin-hole, so that the other surface of the layer 12, which is touched by the brush fibers 21*a*. is not charged adequately. This produces a zone of non-uniformity of the charged potential on the surface of the photosensitive layer 12. This problem of the pin-holes is solved by introducing a pulse removing circuit into the constant-current power supply for the brush type charging unit firstly embodying the present invention.

Figure 14:
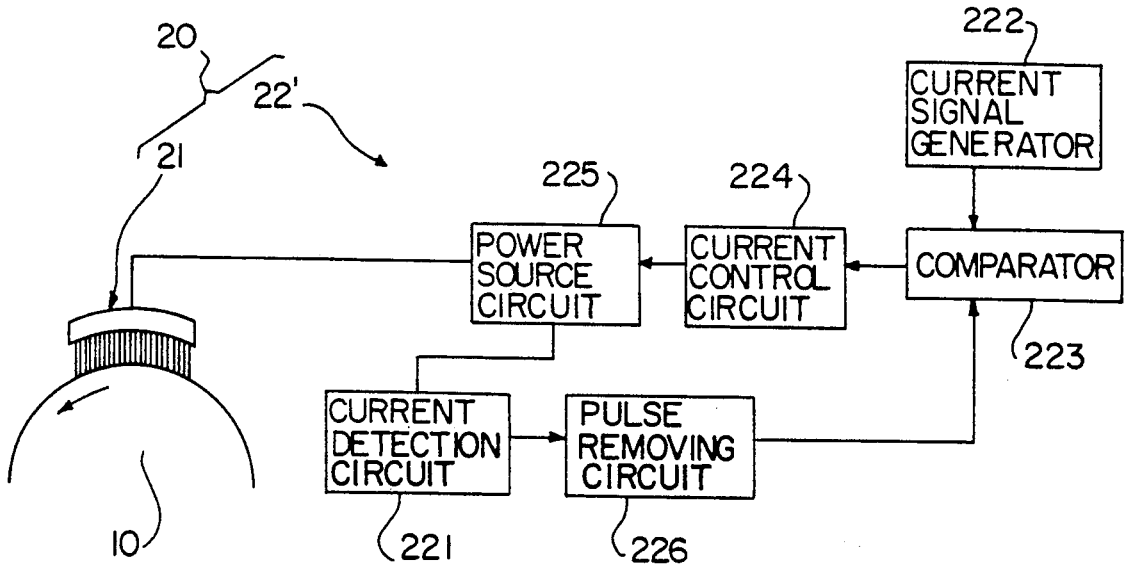
FIG. 14' is a block diagram of the constant-current regulated power supply including a pulse removing circuit for the brush type charging unit.

A block diagram of a constant-current regulated power supply 22', including the pulse removing circuit 226, secondly embodying the present invention is shown in FIG. 14, and the detailed circuit of the power supply 22' is shown in FIG. 16. In FIG. 14, the same reference numbers as in FIG. 7 designate the same units or parts as in FIG. 7, and in FIG. 16, the same reference numbers as in FIG. 8 designate the same units or parts as in FIG. 8.

A pulse removing circuit 226 is provided between the current detection circuit 221 and the comparator 223 as shown in FIG. 14. The function of the constant current regulated power supply 22' will be described below.

The area of a pin-hole is about $8\times10^{-5}cm^2$ and the density of the fiber is $1.55\times10^4cm^{-2}$, so that at least one or two pieces of the brush fibers 21*b* touch the surface of aluminum cylinder 11 in a pin-hole when the photosensitive layer 12 is moved. This causes a large short current, which will be called a "pulse current" hereinafter, to flow through the pieces of the brush fibers 21*b*. A time for allowing the pulse current flow is determined by the width (reference symbol W in FIG. 2) of the brush fibers 21*b* and the moving velocity of the cylindrical surface of the drum 10, and the time is usually several hundred milliseconds. When the pulse current flows, the current detection circuit 221 detects the flow of the pulse current. Therefore, if the constant current regulated power supply is used as that described in FIG. 8, the control circuit 224 controls so as to decrease the magnitude of the pulse current by lowering the output voltage of the high voltage power source circuit 225, thereby causing the charging of the photosensitive layer 12 to stop.

In the constant-current regulated power supply 22', the pulse removing circuit 226 operates for stopping the current from the constant-current regulated power supply this is concentrated in the pin-hole. This is achieved by stopping the current signal sending directly to the comparator 223 from the current detection circuit 221 when the pulse current flowing. By stopping the current signal, the output of the high voltage power source circuit 225 is kept to the same voltage as the output obtained just before the brush fibers 21*b* touch the pin-hole. In doing so, the charging of the photosensitive layer 12 can be performed adequately over the surface of the photosensitive layer 12 at any time the brush fibers 21*b* touch the pin-hole.

The pulse removing circuit 226 can comprise a conventional low pass filter circuit consisting of resistors R1 and R2, capacitors C1 and C2 and an operational amplifier OP1 as shown in FIG. 15. In the second embodiment, the resistance of R1 and R2 are set equally to R, and the capacitance of the C2 is equal to a half of the capacitance of C1, so that the cut-off frequency ($f_c$) of the low pass filter is given by $f_c=(2\pi C_1R)^{-1}$. If the maximum pulse width of the pulse current is 500 ms, the cut-off frequency fc becomes 2 Hz. The values of R and $C_1$ are determined from the cut-off frequency previously designated.

The circuit diagram of the constant current regulated power 22' is shown in FIG. 16, including the pulse removing circuit 226. In FIG. 16, the same reference numbers as in FIG. 8 designate the same units or parts as in FIG. 8. In FIG. 16, the current in the brush charger 21 is detected by a detected voltage obtained at the resistor R3 of the current detection circuit 221. The detected voltage is amplified by the AMP1 and sent to the pulse removing circuit 226 consisting of the low-pass filter circuit as shown in FIG. 15. When the charging current from the constant-current regulated power supply 22' includes the pulse current, a pulsed detected voltage, which will be called a "pulse signal" hereinafter, having a rapid amplitude variation is included in the output signal from the current detection circuit 221. However, when the output signal from the current detection circuit 221 is sent to the comparator 223, the pulse signal is eliminated by the pulse removing circuit 226 consisting of the low-pass filter circuit shown in FIG. 15. Accordingly, the photosensitive layer 12 is regularly charged as if there were no pin-hole even when the brush fibers 21*b* touch the pin-hole. Other functions of the constant-current regulated power supply 22' are the same as the functions of the constant-current regulated power supply 22 firstly embodying the present invention.

In the constant current regulated power supply 22' described above, the pulse removing circuit 226 is placed between the current detection circuit 221 and the comparator 223; however, the pulse removing circuit 226 can be placed between the comparator 223 and the current control circuit 224.

In the pulse removing circuit 226, the low-pass filter circuit is used for removing pulse signals; however, any other circuits having the function of removing the pulse signals can be used as the pulse removing circuit 226.

Uniform charging of the drum 10 can be achieved, even in a case where the fibers 21b touch the pin-hole, by using the constant current regulated power supply 22'. However, the brush fibers can burn out due to an excess current flowing through the brush fibers when the brush fibers touch the pin-hole.

The third embodiment of the present invention offers means for preventing such a catastrophic damage of burning occurring in the brush fibers 21b.

Figure 17A:
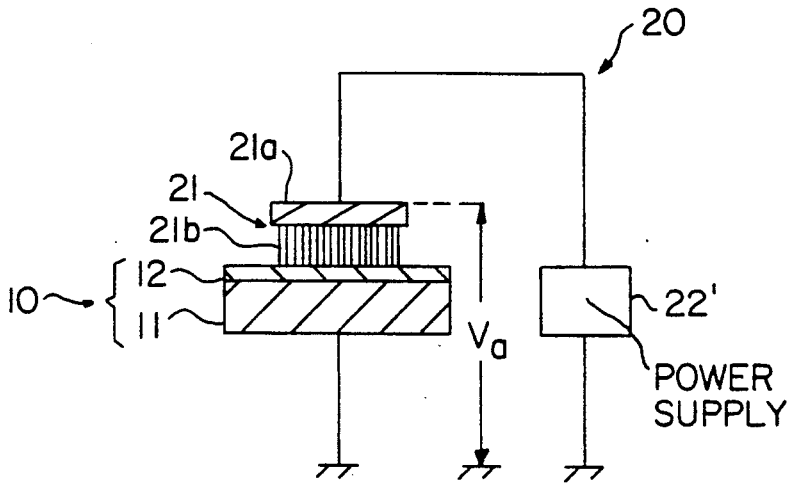
FIG. 17'(*a*) is a schematic view of a charging model of the brush charger on a part of the photosensitive drum.
Figure 17B:
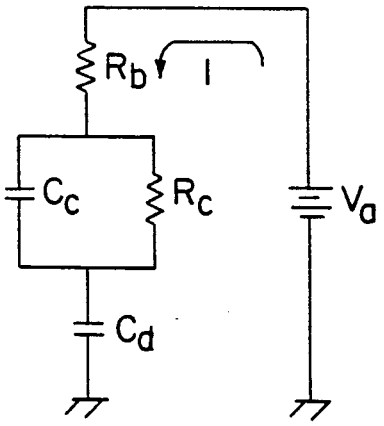

FIG. 17(*a*) is a schematic view showing the brush charger 21 charging the drum 10 with the constant current regulated power supply 22'. In FIG. 17(*a*), the same reference numbers as in FIG. 4 designate the same units or parts as in FIG. 4. In FIG. 17(*a*), a high voltage $V_a$ is applied to the photosensitive layer 12 on the aluminum cylinder 11 through the brush base 21a and the brush fiber 21b; the aluminum cylinder 11 and one output terminal of the power supply 22' are grounded.

FIG. 17(*b*) shows an equivalent circuit of FIG. 17(*a*). In FIG. 17(*b*), a reference symbol $V_a$ represents a high voltage, from the constant-current regulated power supply, applied to the brush fibers 21b and the drum which are in contact with each other; a reference symbol $R_b$ represents a resistor of a fiber element of the brush fibers 21b and also its resistance; a reference symbol $R_c$ represents a contact resistor between the fiber element and the photosensitive layer 12 and also its resistance; a reference symbol $C_c$ represents a capacitor present at a contact region between the tip of the fiber element and the surface of the photosensitive layer 12 and also its capacitance; a reference symbol $C_d$ represents a capacitor present at the photosensitive layer 12 and also its capacitance; and a reference symbol I represents a charging current flowing through the fiber element.

In FIG. 17(*b*), when the fiber element touches the aluminum cylinder 11, the current I has a value determined by an equation $V_a/(R_b+R_c)$ in a steady state. Usually the $R_c$ is extremely smaller than the $R_b$, so that the resistor $R_b$ starts to burn at last as the current I increases. The resistance $R_b$ at the beginning of burning will be called a "critical value" and a current flowing through the resistor $R_b$ having the critical value will be called a critical current $I_b$ hereinafter. In order to determine the critical current $I_b$, an experiment was performed by the inventor.

In the experiment, the critical current $I_b$ is measured by increasing the applied voltage $V_a$ and using fiber elements made of rayon having various resistances and diameters. The results of the measurement are shown with a graph in FIG. 18. In the measurement, the sizes and the lengths of the fiber elements are normalized in one denier and one mm respectively; wherein, one denier is a unit as to the size of the fiber element; that is, one denier is a size of the fiber element having one gram in weight and 9,000 m in length.

Figure 18:
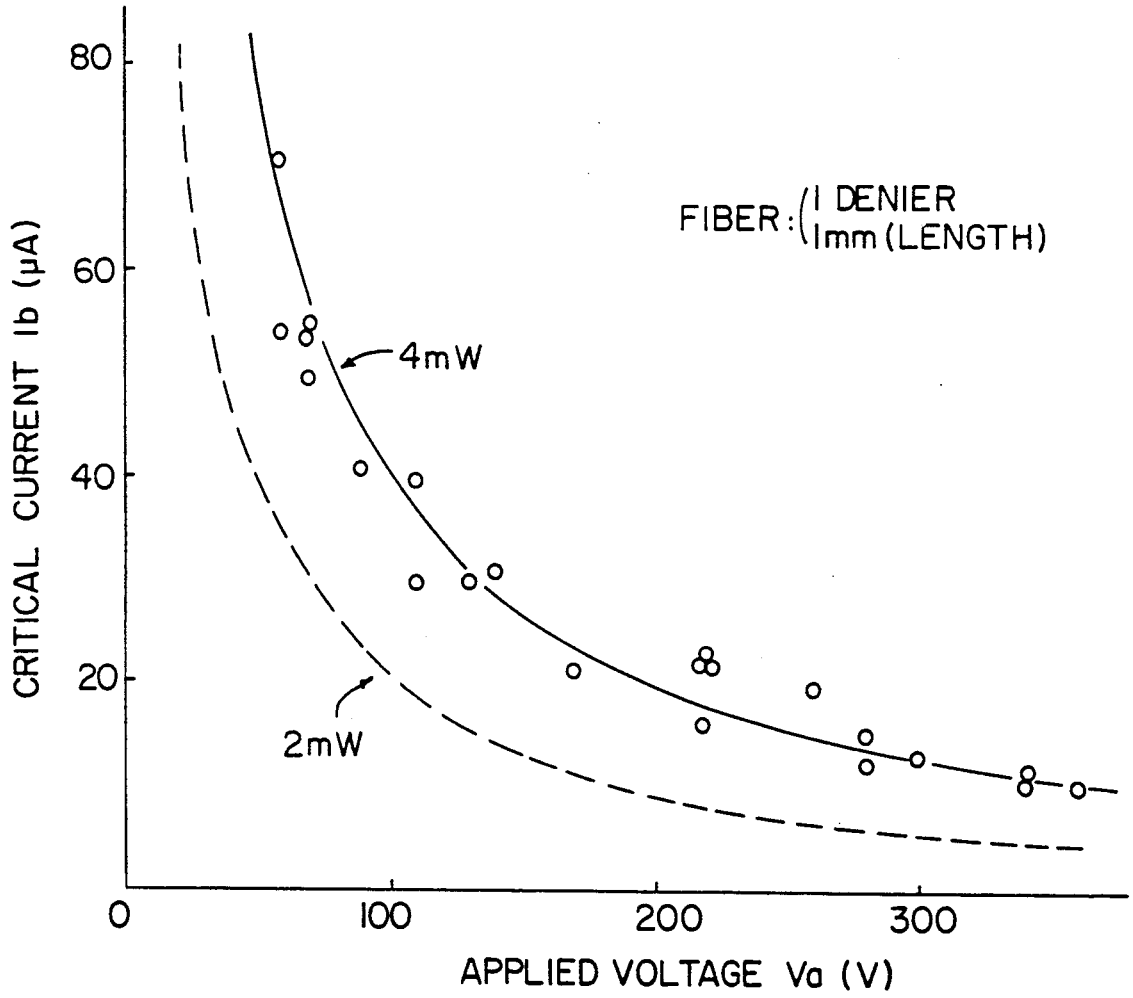
FIG. 18' is a graph showing, for a piece of brush fiber, the variation of a critical current to begin burning the brush fiber, corresponding to the change of a voltage applied to the brush fiber.

In FIG. 18, the white circles are the points of the measured critical currents $I_b$ obtained by varying the applied voltage $V_a$, and a solid curve represents a curve in the case of $I_b \times V_a = 4$ mW. Comparing the measured points and the solid curve, it can be realized that the solid curve of 4 mW fairly agrees with the measured critical currents $I_b$. This means that the fiber element made of rayon of 1 denier in size and 1 mm in length is burned out when the 4 mW power is given to the fiber element. From the measured results and the solid curve in FIG. 18, it can be assumed that it may be free from burning and of practical use if the fiber element is selected so as to dissipate below 2 mW; a broken curve in FIG. 18 shows a curve in the case of 2 mW.

The high voltage power supply circuit produce an output voltage of 1,500V as a maximum. Therefore, when the fiber length is 5 mm, the resistance of the fiber element becomes $4.5 \times 10^7$ ohm per 1 denier and 1 mm or more. Thus, the lower limit of the resistance of the fiber element is determined.

Figure 19:
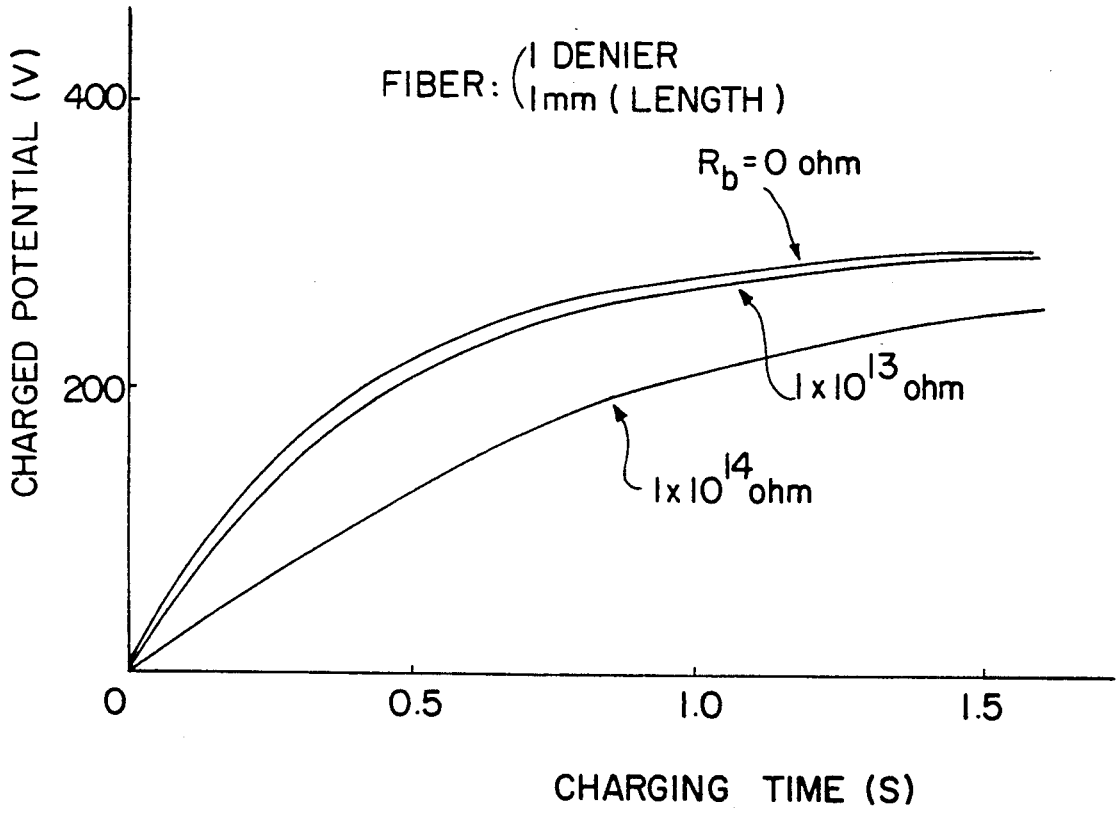
FIG. 19' is a graph showing a charged potential to a charging time respectively in three brush fibers each having different resistance.

The upper limit of the resistance of the fiber element is determined by calculating three curves, which show the relationship between the charged potential and the charging time, as shown in FIG. 19. When the resistance $R_c$ is $3 \times 10^5$ ohm, the capacitance Cd is 1.0 $\mu F/m^2$ and the capacitance $C_c$ is 0.2 $\mu F/m^2$, the three curves are calculated by setting the resistance $R_b$ to 0 ohm, $1 \times 10^{13}$ ohm and $1 \times 10^{14}$ ohm respectively.

From the three curves in FIG. 19, it can be concluded that the resistance $R_b$ of the fiber element should be smaller than $1 \times 10^{13}$ ohm, because the charged potential is lowered when the resistance $R_b$ of the fiber element is increased more than $1 \times 10^{13}$ ohm, as seen from FIG. 19.

The electrical insulation of the brush charger described in FIGS. 12 and 13 can be used not only for an organic photoconductor drum, but also for a selenium compound photoconductor drum or amorphous silicon photoconductor drum. As the image forming medium, a belt or film type medium can be used instead of the drum type.

What is claimed is:

1. An electrostatic charging unit in an image forming apparatus, for charging a photosensitive medium located in the image forming apparatus and moving at a constant velocity, the charging unit comprising:

(a) a brush type charger for charging the moving photosensitive medium by contact of said brush type charger with the moving photosensitive medium; and (b) a constant-current regulated power supply for supplying a current to the moving photosensitive medium through said brush type charger and controlling the current so as to flow constantly, said constant-current regulated power supply including a pulse current removing circuit for making the current flow free from the constant flow control of the current when the current changes in a state of pulse.

2. An electrostatic charging unit according to claim 1, wherein said constant-current regulated power supply further comprises:

a high voltage power supply circuit for driving the current into the photosensitive medium through said brush type charger;

a current detection circuit for detecting a flow rate of the current and producing a detected current signal;

a standard current signal generation circuit for generating a standard current signal;

a comparator for comparing the detected current signal and the standard current signal, and producing a comparator output signal; and a current control for controlling the output of the comparator so as to be zero.

3. An electrostatic charging unit according to claim 1, wherein said pulse removing circuit comprises a low pass filter circuit having a cut-off frequency determined by the width of the brush type charger and the velocity of the moving photosensitive medium.

4. An electrostatic charging unit according to claim 1, wherein said brush type charger comprises:

a conductive base electrically connected to said constant-current regulated power supply;

conductive brush fibers having tips in contact with the surface of said photosensitive medium; and conductive glue means for gluing said conductive brush fibers to said conductive base.

5. An electrostatic charging unit according to claim 4, further comprising an insulation block made of one of fluororesin, epoxy resin and silicon resin and wherein said conductive base is insulated from a ground potential of said constant-current regulated power supply by said insulation block.

6. An electrostatic charging unit according to claim 4, further comprising an insulating film around said conductive base and made of one of fluororesin, epoxy resin and silicon resin, and wherein said conductive base is insulated from a ground potential of said constant-current regulated power supply by said insulating film.

7. An electrostatic charging unit according to claim 4, wherein said conductive brush fibers comprise a plurality of fiber elements, each fiber element having resistance such that the current is kept below a critical value for preventing burning of said fiber element when the current flows through said conductive brush fibers.

8. An electrostatic charging unit according to claim 7, wherein said fiber element has resistance between $4.5\times10^7$ ohm and $1\times10^{13}$ ohm when said fiber element is 1 denier in size and 1 mm, in length.

9. An electrostatic charging unit in an image forming apparatus, for charging a photosensitive medium located in the image forming apparatus and moving at a constant velocity, the charging unit comprising:

(a) a brush type charger for charging the moving photosensitive medium, said brush type charger including (i) a conductive base electrically connected to a constant-current regulated power supply;

(ii) conductive brush fibers having tips for contacting and thereby charging a surface of said moving photosensitive medium; and (iii) a plurality of fiber elements, each element having resistance between $4.5\times10^7$ ohm and $1\times10^{13}$ ohm when said fiber element is 1 denier in size and 1 mm in length such that the current is kept below a critical value for preventing burning of said fiber elements when the current flows through said conductive brush fibers; and (iv) conductive glue means for gluing said conductive brush fibers to said conductive base; and (b) a constant-current regulated power supply for supplying a current to the moving photosensitive medium through said brush type charger and controlling the current so as to flow constantly, said constant-current regulated power supply including a pulse current removing circuit for making the current flow from the constant flow control of the current when the current changes in a state of pulse.

10. An electrostatic charging unit according to claim 9, wherein said constant-current regulated power supply further comprises:

a high voltage power supply circuit for driving the current into the photosensitive medium through said brush type charger;

a current detection circuit for detecting a flow rate of the current and producing a detected current signal;

a standard current signal generation circuit for generating a standard current signal;

a comparator for comparing the detected current signal and the standard current signal, and producing a comparator output signal; and a current control circuit for controlling the output of the comparator so as to be zero.

11. An electrostatic charging unit according to claim 9, wherein the pulse removing circuit comprises a low pass filter circuit having a cut-off frequency determined by the width of the brush type charger and the velocity of the moving photosensitive medium.

12. An electrostatic charging unit according to claim 9, further comprising an insulation block made of one of fluororesin, epoxy resin and silicon resin and wherein said conductive base is insulated from a ground potential of said constant-current regulated power supply by said insulation block.

13. An electrostatic charging unit according to claim 9, further comprising an insulating film around said conductive base and made of one of fluororesin, epoxy resin and silicon resin, and wherein said conductive base is insulated from a ground potential of said constant-current regulated power supply by said insulating film.

14. An electrostatic charging unit in an image forming apparatus, for charging a photosensitive medium located in the image forming apparatus and moving at a constant velocity, the charging unit comprising:

(a) a brush type charger for charging the moving photosensitive medium, said brush type charger including (i) conductive brush fibers having tips for contacting and thereby charging a surface of said moving photosensitive medium;

(ii) a conductive base electrically connected to said conductive brush fibers and a constant-current regulated power supply; and (iii) a plurality of fiber elements, each element having resistance between $4.5\times10^7$ ohm and $1\times10^{13}$ ohm when said fiber element i 1 denier in size and 1 mm in length such that the current is kept below a critical value for preventing burning of said fiber element when the current flows through said conductive brush fibers; and (b) a constant-current regulated power supply for supplying a current to the moving photosensitive medium through said brush type charger and controlling the current so as to flow constantly, said constant-current regulated power supply including a pulse current removing circuit for making the current flow free from the constant flow control of the current when the current changes in a state of pulse.

15. An electrostatic charging unit according to claim 14, wherein said constant-current regulated power supply further comprises:

a high voltage power supply circuit for driving the current into the photosensitive medium through said brush type charger;

a current detection circuit for detecting a flow rate of the current and producing a detected current signal;

a standard current signal generation circuit for generating a standard current signal;

a comparator for comparing the detected current signal and the standard current signal, and producing a comparator output signal; and a current control circuit for controlling the output of the comparator so as to be zero.

16. An electrostatic charging unit according to claim 14, wherein said pulse removing circuit comprises a low pass filter circuit having a cut-off frequency determined by the width of the brush type charger and the velocity of the moving photosensitive medium.

17. An electrostatic unit according to claim 14 further comprising an insulation block made of one of fluororesin, epoxy resin and silicon resin and wherein said conductive base is insulated from a ground potential of said constant-current regulated power supply by said insulation block.

18. An electrostatic charging unit according to claim 14, further comprising an insulating film around said conductive base and made of one of fluororesin, epoxy resin and silicon resin, and wherein said conductive base is insulated from a ground potential of said constant-current regulated power supply by said insulating film.

* * * * *

UNITED STATES PATENT AND TRADEMARK OFFICE

CERTIFICATE OF CORRECTION

PATENT NO. : 5,012,282

DATED : April 30, 1991

INVENTOR(S) : Masahiro Wanou et al.

It is certified that error appears in the above-identified patent and that said Letters Patent is hereby corrected as shown below:

TITLE PAGE: under U.S. Patent Documents, "6/1985" should be --6/1983--.

Front Page, under Foreign Patent Documents, insert the following: --0180378 5/86 EPC
0035745 9/81 EPC--.

Col. 1, line 26, "medium thereby," should be --medium, thereby--;
line 36, after "namely" insert --a--.

Col. 2, line 5, delete "the";
line 13, after "increases" insert a comma;
line 37, after "However" insert a comma.

Col. 3, line 48, "However;" should be --However,--.

UNITED STATES PATENT AND TRADEMARK OFFICE

CERTIFICATE OF CORRECTION

PATENT NO. : 5,012,282

DATED : April 30, 1991

INVENTOR(S) : Masahiro Wanou et al.

It is certified that error appears in the above-identified patent and that said Letters Patent is hereby corrected as shown below:

Col. 4, line 24, "1'" should be --1--;
line 26, "2'" should be --2--;
line 28, "3'" should be --3--;
line 30, "4'" should be --4--;
line 33, "5'" should be --5--;
line 39, "6'" should be --6--;
line 43, "7'" should be --7--;
line 45, "8'" should be --8--;
line 47, "9'" should be --9--;
line 53, "10'" should be --10--;
line 59, "11'" should be --11--;
line 65, "12'" should be --12--;
line 66, "foam-" should be --forming--;
line 67, delete "ing".

Col. 5, lines 1, 4, 7, 9, 12, 15, 17 and 21, delete the prime mark;
line 43, "follows" should be --follows:--.

Col. 7, line 56, "of" should be --or--.

Col. 9, line 26, "50uthickness" should be --50μ thickness--.

Col. 10, line 20, "flowing" should be --flows--.

UNITED STATES PATENT AND TRADEMARK OFFICE

CERTIFICATE OF CORRECTION

PATENT NO. : 5,012,282

DATED : April 30, 1991

INVENTOR(S) : Masahiro Wanou et al.

It is certified that error appears in the above-identified patent and that said Letters Patent is hereby corrected as shown below:

Col. 12, line 10, "produce" should be --produces--;
line 20, "Cd" should be --$C_d$--.

Col. 14, line 49, delete "i".

Signed and Sealed this

Thirteenth Day of October, 1992

*Attest:*

DOUGLAS B. COMER

*Attesting Officer*

*Acting Commissioner of Patents and Trademarks*